United States Patent [19]

Baur

[11] 4,431,554

[45] * Feb. 14, 1984

[54] OIL-IN-WATER EMULSION FOR COLD ROLLING LIGHT METALS

[75] Inventor: Rudolf Baur, Kreuzlingen, Switzerland

[73] Assignee: Swiss Aluminium Ltd., Chippis, Switzerland

[ * ] Notice: The portion of the term of this patent subsequent to Apr. 27, 1999 has been disclaimed.

[21] Appl. No.: 213,848

[22] Filed: Dec. 8, 1980

[30] Foreign Application Priority Data

Sep. 12, 1980 [CH] Switzerland ..... 6864/80

[51] Int. Cl.[3] ..... C10M 3/26

[52] U.S. Cl. ..... 252/49.5

[58] Field of Search ..... 252/49.3, 49.5

[56] References Cited

U.S. PATENT DOCUMENTS 3,390,084 6/1968 Lake ..... 252/49.3 X
3,835,052 9/1974 McDole et al. ..... 252/49.5
4,062,784 12/1977 Baur ..... 252/49.5
4,115,282 9/1978 Grasshoff ..... 252/49.5 X
4,326,974 4/1982 Baur ..... 252/495

OTHER PUBLICATIONS

Hawley; G. G. (Editor), "The Condensed Chemical Dictionary", Ninth Edition, p. 648, "Palm Oil".

Chem. Abstracts, vol. 87, 1977, 155942d, Baur, Aus. 2,632,142, 2/77.

*Primary Examiner*—Andrew Metz

*Attorney, Agent, or Firm*—Bachman and LaPointe

[57] ABSTRACT

1000 Parts by weight of oil-in-water emulsion contain 10-70 parts by weight of palm kernel oil as reaction layer former, 5-20 parts by weight of poly-ethoxylated sorbitanoleate as emulsifier, 5-25 parts by weight of unsaturated, long chain monocarboxylic acids as inhibitor against hydrogen embrittlement and rusting, 1–25 parts by weight hexamethylenetetramine as stabilizer, fungicide and bactericide, rest deionized water. The emulsion is particularly suitable for cold rolling aluminum and aluminum alloys. The rolled strip materials exhibit excellent surface quality also after high reductions per pass.

10 Claims, No Drawings

OIL-IN-WATER EMULSION FOR COLD ROLLING LIGHT METALS

BACKGROUND OF THE INVENTION

The invention relates to an oil-in-water emulsion for cold rolling light metals, in particular aluminum and its alloys wherein the said emulsion contains a reaction layer former, polyethoxylated sorbitanoleates as emulsifier, unsaturated, long chain monocarboxylic acids as inhibitor against hydrogen embrittlement and rusting, hexamethylenetetramine as stabilizer, fungicide and bactericide and deionized water as the balance.

Compared with oil-based rolling lubricants oil-in-water emulsions provide much better cooling due to the high heat of vaporization of water. Consequently they permit greater reductions per pass and/or higher rolling speeds. Besides these purely economic factors, which help considerably to achieve better efficiency, it must be mentioned that aqueous rolling lubricants also markedly reduce the problems of waste gases and fumes and are less depedent on mineral oil. The light metal industries, in particular the aluminum industry, have therefore already carried out many trials to enable oil-in-water emulsions to be employed for cold rolling strip materials.

From the German Auslegeschrift No. 26 32 142 an oil-in-water emulsion for cold rolling light metals is known and contains alkylmonocarboxylic acid esters as reaction layer former, polyisobutylene as hydrodynamic film former, polyethoxylated sorbitanoleate as emulsifier, unsaturated, long chain monocarboxylic acids as inhibitor against hydrogen embrittlement and rusting, hexamethylenetetramine as stabilizer, fungicide and bactericide, balance deionized water.

With the emulsion from the German Auslegeschrift No. 26 32 142 it was in fact possible to achieve reductions of close to 90% with aluminum. However, the poorer surface quality produced by the high reductions per rolling pass did not always meet the requirements made of strip and foil surfaces.

SUMMARY OF THE INVENTION

In view of these facts it is an object of the invention to develop an oil-in-water emulsion of the kind mentioned at the start for cold rolling light metals, in particular aluminum and aluminum alloys, by mens of which high reductions per pass can be achieved without markedly reducing the surface quality of the rolled strip.

This object is achieved by way of the invention in that the emulsion contains palm kernel oil as a reaction layer former. It has been found that with palm kernel oil as reaction layer former apparently almost optimal conditions can be achieved in the roll gap. This is expressed as an only slight increase in the advancement of the rolled strip, with respect to the peripheral speed of the rolls, at high reductions per pass. The resultant, more precise imprinting of the roll surface on the rolled strip produces at high reductions of >90% less pronounced smearing of the strip surface, which is equivalent to a smaller drop in surface quality.

DETAILED DESCRIPTION

In the case of a preferred oil-in-water emulsion 1000 parts by weight of the emulsion comprise 10 to 70 parts by weight of palm kernel oil as reaction layer former, 5–20 parts by weight of polyethoxylated sorbitanoleates as emulsifier, 5–25 parts by weight of unsaturated, long chain monocarboxylic acids as inhibitor against hydrogen embrittlement and rusting, 1 to 25 parts by weight hexamethylenetetramine as stabilizor, fungicide and bactericide, balance deionized water.

The emulsion can also contain polyisobutylene and/or paraffin oil as hydrodynamic film former. By making this addition the stability of conditions in the roll gap are apparently increased further so that larger fluctuations in the composition of the emulsion have almost no noticeable effect on the rolling process, which ensures constant surface quality in the rolled strip. 1000 parts by weight of emulsion contain preferably 5–50 parts by weight of a polyisobutylene with an average molecular weight of 460, 5–50 parts by weight of a polyisobutylene with an average molecular weight of 320 and/or 5–50 parts by weight paraffin oil.

As emulsifier the emulsion contains preferably sorbitol-polyoxyethylene-hexaoleate, polyoxyethylene-sorbitan-monooleate and/or polyethoxylated sorbitan esters from fatty and resinic acids.

As inhibitor of hydrogen embrittlement and rusting the emulsion contains preferably oleic acid, linoleic acid and/or linolenic acid.

It is known that when oil-in-water emulsions are used, in particular for cold rolling aluminum, the metal surface freshly formed by rolling reacts with water within only a few seconds. This corrosive attack of the surface by the water phase causes undesirable staining of the strip surface. The poorer surface quality of the strip or foil due to these water stains makes the material unsuitable for many applictions. It is therefore normal when employing oil-in-water emulsions to remove the emulsion as completely as possible from the rolled surface immediately after the strip emerges from the rolls, for example by blowing it off with compressed air.

It is no longer absolutely necessary to remove the emulsion if it contains xylitol and sorbitol to inhibit water staining. Water staining is prevented to a large degree by the addition of both xylitol and sorbitol. The inhibitor is already fully effective when 1000 parts by weight of emulsion contain 1–30 parts by weight each of xylitol and sorbitol.

It has furthermore been found that the effect of the inhibitor made up of xylitol and sorbitol can be increased by adding glycerine. The emulsion can usefully contain 20–90 parts by weight of glycerine per 1000 parts by weight of emulsion.

The addition of xylitol, sorbitol and glycerine does not affect the rolling process and, on subsequently annealing the rolled strip, does not lead to residues being left on the surface of the strip.

The following examples show the advantages of the oil-in-water emulsion according to the invention.

EXAMPLE 1

Cold rolling trials with aluminum of purity 99.2% were carried out on a single quarto rolling mill using emulsions with the compositions listed in Table 1. Reductions of up to 92% per roll-pass were carried out. The surface quality of the rolled aluminum was excellent. In no case were signs of water staining observed. Likewise, none of the emulsions led to residues on the strip surface after subsequently annealing the rolled strip.

The emulsions were prepared by mixing and stirring the organic components at room temperature and then diluting to the required degree by adding deionized water. Both, separate phases were then worked up to an emulsion in an emulsifying machine.

TABLE 1

| Emulsion No. | Composition of the emulsions in parts by weight per 1000 parts by weight of emulsion | | | | | | | | | |
|---|---|---|---|---|---|---|---|---|---|---|
| | A | B | C | D | E | F | G | H | I | K |
| 1 | — | — | — | 30 | 10 | 10 | 10 | — | 10 | 10 |
| 2 | — | — | — | 30 | 10 | 10 | 10 | 50 | 10 | 10 |
| 3 | — | — | 10 | 30 | 10 | 10 | 10 | — | 10 | 10 |
| 4 | — | — | 10 | 30 | 10 | 10 | 10 | 50 | 10 | 10 |
| 5 | 10 | — | 20 | 30 | 10 | 10 | 10 | — | 10 | 10 |
| 6 | 10 | — | 20 | 30 | 10 | 10 | 10 | 50 | 10 | 10 |
| 7 | 20 | 10 | 10 | 30 | 10 | 10 | 10 | — | 10 | 10 |
| 8 | 20 | 10 | 10 | 30 | 10 | 10 | 10 | 50 | 10 | 10 |

A: Polyisobutylene, average molecular weight 460
B: Polyisobutylene, average molecular weight 320
C: Paraffin oil
D: Palm kernel oil
E: Sorbitol-polyoxyethylene-hexaoleate
F: Oleic acid
G: Hexamethylenetretramine
H: Glycerine
I: Xylitol
K: Sorbitol

EXAMPLE 2

Using emulsion No. 6 from Example 1 samples of a 6 mm thick strip of aluminum of purity 99.2% were rolled with various reductions in one single pass. The results presented in Table 2 show clearly that the greater speed of the rolled strip, with respect to the peripheral speed of the rolls, does not occur until high reductions and even at a reduction of 92% is still relatively small.

TABLE 2

| Reduction % | Peripheral speed of rolls m/min | Exit speed of strip m/min | Tensile strength of the rolled strip $N/mm^2$ |
|---|---|---|---|
| 50 | 150 | 150 | 148 |
| 67 | 150 | 150 | 165 |
| 83 | 65 | 68 | 170 |
| 88 | 70 | 80 | 178 |
| 92 | 40 | 50 | 184 |

What is claimed is:

1. Oil-in-water emulsion for cold rolling light metals, in particular aluminum and aluminum alloys, containing a reaction layer former, polyethoxylated sorbitanoleates as emulsifier, unsaturated long chain monocarboxylic acids to inhibit hydrogen embrittlement and resting, hexamethylenetetramine as stabilizer, fungicide and bactericide and the balance deionized water, wherein the emulsion contains from 1–7% palm kernel oil as reaction layer former.

2. Oil-in-water emulsion for cold rolling light metals, in particular aluminum and aluminum alloys, in which 1000 parts by weight of emulsion contain 10–70 parts by weight of palm kernel oil as reaction layer former, 5–20 parts by weight of polyethoxylated sorbitanoleates as emulsifier, 5–25 parts by weight of unsaturated, long chain monocarboxylic acids to inhibit hydrogen embrittlement and rusting, 1–25 parts by weight of hexamethylenetetramine as stabilizer, fungicide and bactericide, balance deionized water.

3. Emulsion according to claim 2 wherein the emulsion contains additionally a hydrodynamic film former selected from the group consisting of polyisobutylene, paraffin oil and mixtures thereof.

4. Emulsion according to claim 2 wherein the emulsion contains a hydrodynamic film former selected from the group consisting of 5–50 parts by weight of a polyisobutylene with an average molecular weight of 320, 5–50 parts by weight of a polyisobutylene with an average molecular weight of 460, 5–50 parts by weight of paraffin oil and mixtures thereof.

5. Emulsion according to claim 2 wherein the emulsion contains an emulsifier selected from the group consisting of sorbitol-polyoxyethylene-hexa-oleate, polyoxyethylene-sorbitan-mono-oleate, polyethoxylated sorbitan esters from fatty and resinic acids and mixtures thereof.

6. Emulsion according to claim 2 wherein the emulsion contains a material to inhibit hydrogen embrittlement and rusting selected from the group consisting of oleic acid, linoleic acid, linolenic acid and mixtures thereof.

7. Emulsion according to claim 2 wherein the emulsion contains additionally xylitol and sorbitol to inhibit water staining.

8. Emulsion according to claim 7 wherein 1000 parts by weight of emulsion contain 1–30 parts by weight each of xylitol and sorbitol.

9. Emulsion according to claim 7 wherein the emulsion additionally contains glycerine.

10. Emulsion according to claim 8 wherein 1000 parts by weight of emulsion additionally contains 20–90 parts by weight of glycerine.

* * * * *